US007087868B2

(12) United States Patent
Hamburger et al.

(10) Patent No.: US 7,087,868 B2
(45) Date of Patent: Aug. 8, 2006

(54) HEATING DEVICE

(75) Inventors: Andreas Hamburger, Germersheim (DE); Werner Fassbinder, Philippsburg (DE)

(73) Assignees: Eichenauer Heizelemente GmbH & Co. KG, Kandel (DE); Beru AG, Ludwigsburg (DE)

( * ) Notice: Subject to any disclaimer, the term of this patent is extended or adjusted under 35 U.S.C. 154(b) by 0 days.

(21) Appl. No.: 10/821,839

(22) Filed: Apr. 12, 2004

(65) Prior Publication Data

US 2004/0200830 A1 Oct. 14, 2004

(30) Foreign Application Priority Data

Apr. 12, 2003 (DE) ..... 103 16 908

(51) Int. Cl.
*H05B 3/02* (2006.01)

(52) U.S. Cl. ..... 219/541; 219/225; 219/505; 219/525; 219/538; 219/539; 219/537; 219/476; 338/22 R; 338/306

(58) Field of Classification Search ..... 219/230, 219/525, 538, 539, 540, 541, 544, 548, 553, 219/542, 225, 505, 537, 476, 477, 478; 392/432, 392/485, 435; 338/22 R, 306, 312, 325, 338/328

See application file for complete search history.

(56) References Cited

U.S. PATENT DOCUMENTS

| | | | | |
|---|---|---|---|---|
| 4,147,927 | A * | 4/1979 | Pirotte | 219/541 |
| 4,327,282 | A * | 4/1982 | Nauerth | 219/541 |
| 4,330,703 | A * | 5/1982 | Horsma et al. | 219/553 |
| 4,493,972 | A * | 1/1985 | Steinel et al. | 219/230 |
| 4,582,983 | A | 4/1986 | Midgley | |
| 4,835,370 | A * | 5/1989 | Van Bokestal et al. | 219/544 |
| 4,841,127 | A * | 6/1989 | Prager et al. | 219/225 |
| 4,869,878 | A * | 9/1989 | Putz | 422/111 |
| 4,990,748 | A * | 2/1991 | Starck | 392/485 |
| 5,592,647 | A * | 1/1997 | Yamauchi et al. | 392/432 |
| 5,658,479 | A * | 8/1997 | Tadokoro | 219/505 |

FOREIGN PATENT DOCUMENTS

| | | |
|---|---|---|
| DE | 2614433 | 10/1976 |
| DE | 2115878 | 11/1977 |
| DE | 3207015 | 9/1983 |
| DE | 19933013 | 2/2001 |
| DE | 20212580 | 11/2002 |
| EP | 0340550 | 11/1989 |
| FR | 2826829 | 1/2003 |

* cited by examiner

*Primary Examiner*—John A. Jeffery
*Assistant Examiner*—Leonid M. Fastovsky
(74) *Attorney, Agent, or Firm*—Antonelli, Terry, Stout and Kraus, LLP.

(57) ABSTRACT

In order to create a heating device which can operate in different power stages, but only has to be contacted from one side, the invention provides a heating device with at least two plate-like ceramic heating elements, which are electrically contacted on opposite flat sides and on at least one side is provided at least one flat, electrical conductor, in which on one side of the elements there are at least two conductors electrically insulated from one another, each of the conductors being in contact with at least one heating element.

19 Claims, 6 Drawing Sheets

HEATING DEVICE

FIELD OF THE INVENTION

The invention relates to a heating device with at least two plate-like ceramic heating elements electrically contacted on opposite flat sides, at least one flat electrical conductor being provided on at least one side.

BACKGROUND OF THE INVENTION

Devices according to the preamble are e.g. known from EP 379 837 A1 and EP 340 550 B1.

In both cases the electrical heating elements are in an insulating frame, preferably made from plastic, to which is integrated or connected in fixed form a lamellar electrical conductor which directly contacts the heating elements. This arrangement is in the first case formed from a casing in the form of a U-shaped removal part, whose U-shaped legs directly contact the other side of the heating elements, and an insulating strip placed on the conductor. Pressing results from lamellae mounted on said casing. In the second document the casing is constituted by an electrically conductive profile tube, in which is placed the contact arrangement of PTC elements, conductors and insulating strips thereon, after which the casing is pressed. In said heating devices according to the preamble a joint action takes place on all the heating elements.

DE 199 33 013 discloses a heating device with plate-shaped heating elements, which in the extension direction of the heating elements and also the contacting conductor has two separately switchable heating zones. However, for this purpose the heating conductors have to be contacted from two front sides of the device or in each heating zone part of the heating elements must be omitted, so that the heating density or specific heating power is unnecessarily reduced.

Therefore the problem of the invention is to so further develop the heating devices according to the preamble that with an optimum, specific heating power all the heating zones only have to be contacted from one front side.

SUMMARY OF THE INVENTION

According to the invention the set problem is solved by a heating device of the aforementioned type, which is characterized in that on one side of the heating elements are provided in electrically insulated manner from one another at least two conductors and each of the conductors is in contact with at least one heating element.

Thus, according to the invention substantially parallel and mutually insulated lamellar electrical conductors are provided, which are contactable on one side, in which the first conductor leads to at least one first heating element or to a first group of heating elements, a further conductor guided on said remote side of the first conductor and parallel thereto leads to at least one second heating element or a second group of heating elements, a third conductor possibly located on said remote side of the second conductor leads to at least one third heating element or a third group of heating elements and so on, and in this way each conductor is electrically insulated from the further heating elements or groups of heating elements in the same way as the first conductor relative to the second and third heating elements or groups thereof, etc.

Contacting of the heating elements by the conductors can take place directly or indirectly. In the case of direct con tacting the further conductor or conductors, apart from the first conductor, are offset towards the heating elements. Indirect contacting can take place by means of at least one electrically conductive spacer between the conductor plane and the contact surface of the heating element facing the same or several conductive spacers or a spacer and a contact plate. According to further preferred developments of the invention, the heating elements, conductors and optionally spacers are pressed in the casing and the latter is in particular given an electrically conductive construction and at least one flat side of the casing is in electrical contact with the flat side of at least one heating element remote from the at least one conductor.

BRIEF DESCRIPTION OF THE DRAWINGS

Further advantages and features of the invention can be gathered from the following description of embodiments of the invention, the claims and the attached drawings, wherein show:

DETAILED DESCRIPTION OF THE DRAWINGS

Figure 1:
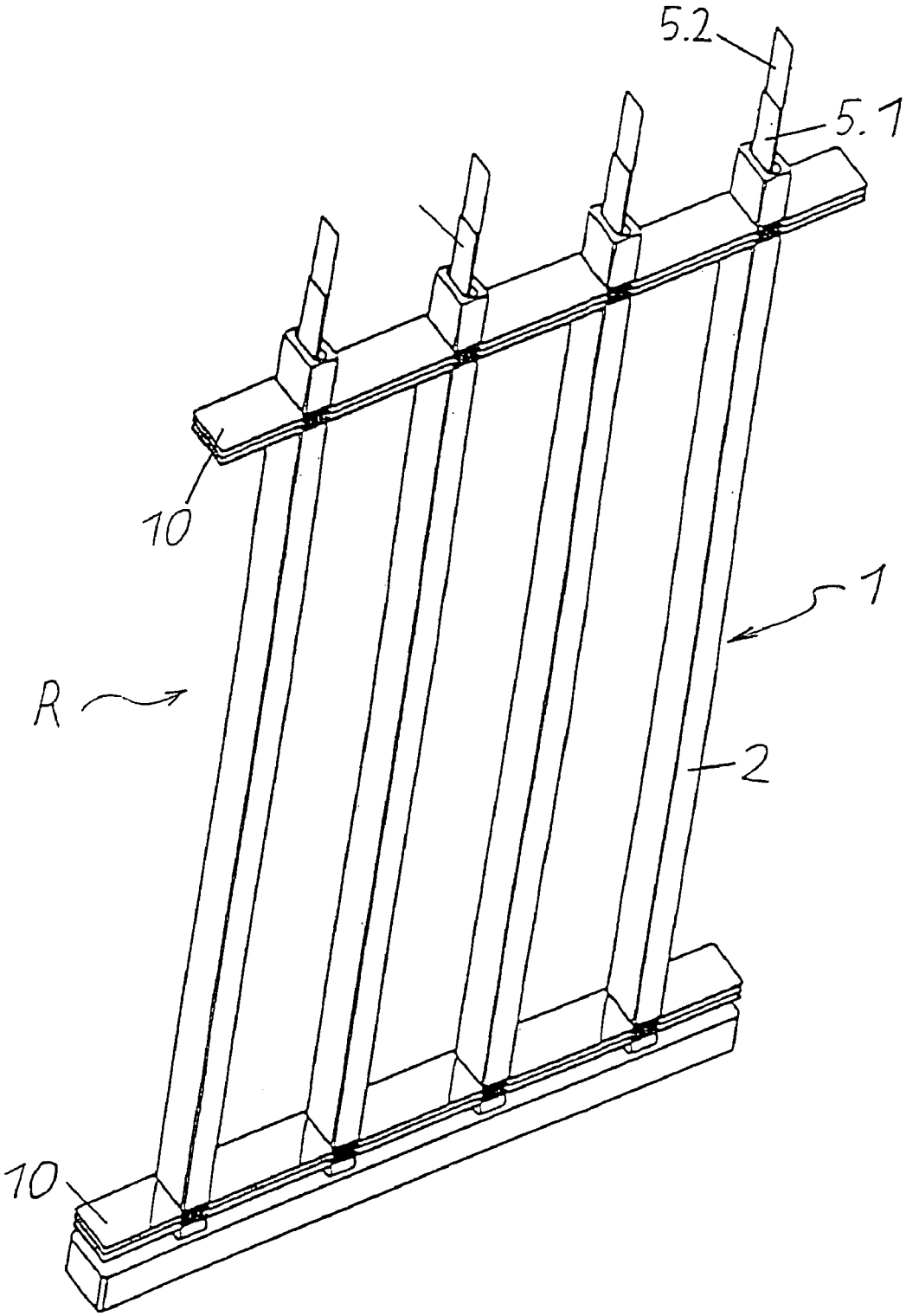
FIG. 1 A perspective view of a radiator with heating devices according to the invention.

FIG. 1 perspectively shows a radiator R comprising four individual heating devices 1 according to the invention. The individual heating devices 1 are interconnected by crossbars 10. Besides the heating elements, holding and insulating elements, which are shown and explained relative to FIGS. 5 to 7, the casing 2 of the inventive heating device 1 constructed in profile tube form, together with conductors 5.1, 5.2 and which are constructed as flat plates and project from the casing 2 are provided. The precise structure and interaction with the heating elements is also described in greater detail hereinafter relative to FIGS. 5 to 7.

Figure 2:
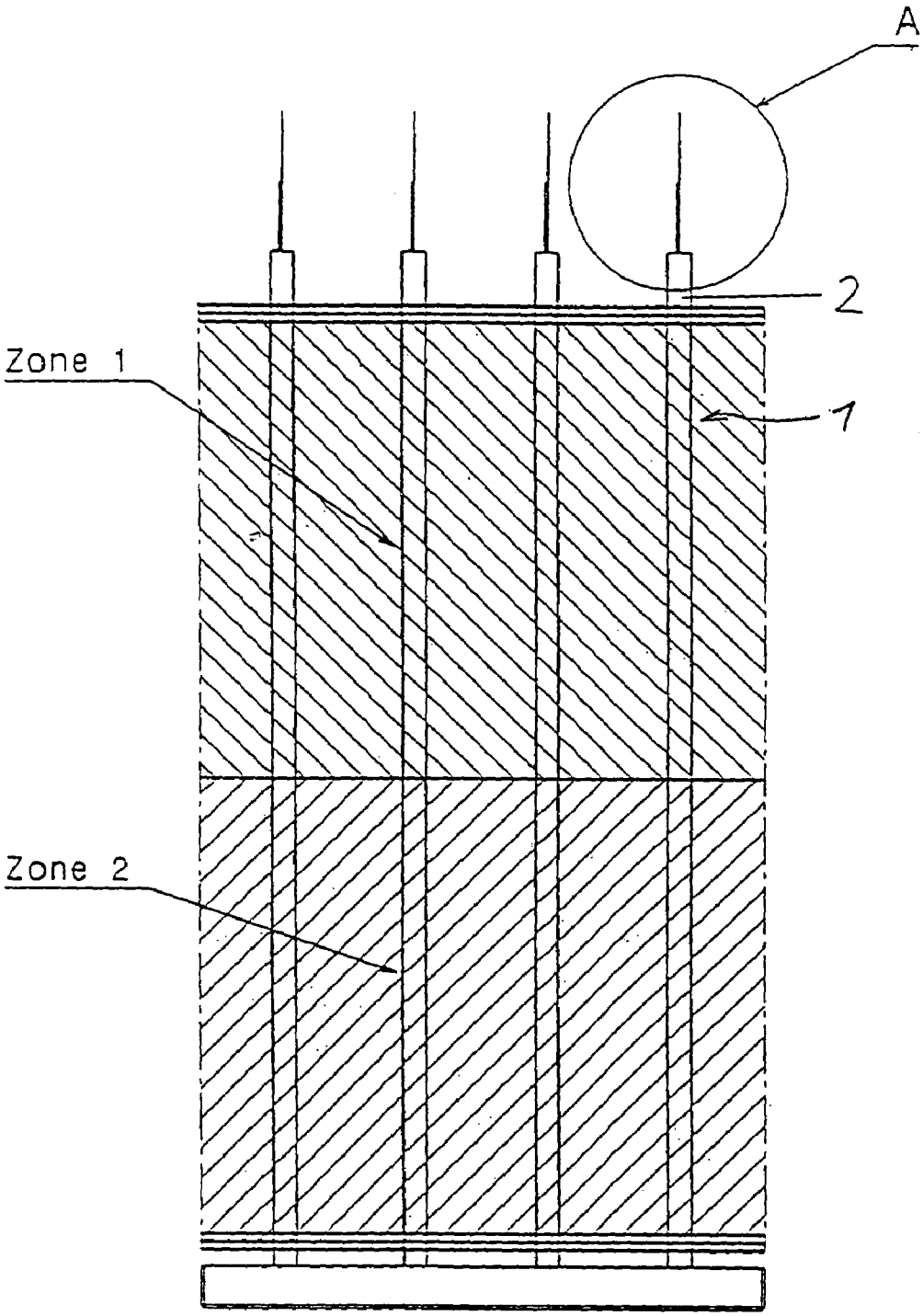
FIG. 2 In side view two inventively obtainable heating zones of the radiator of FIG. 1.
Figure 5:
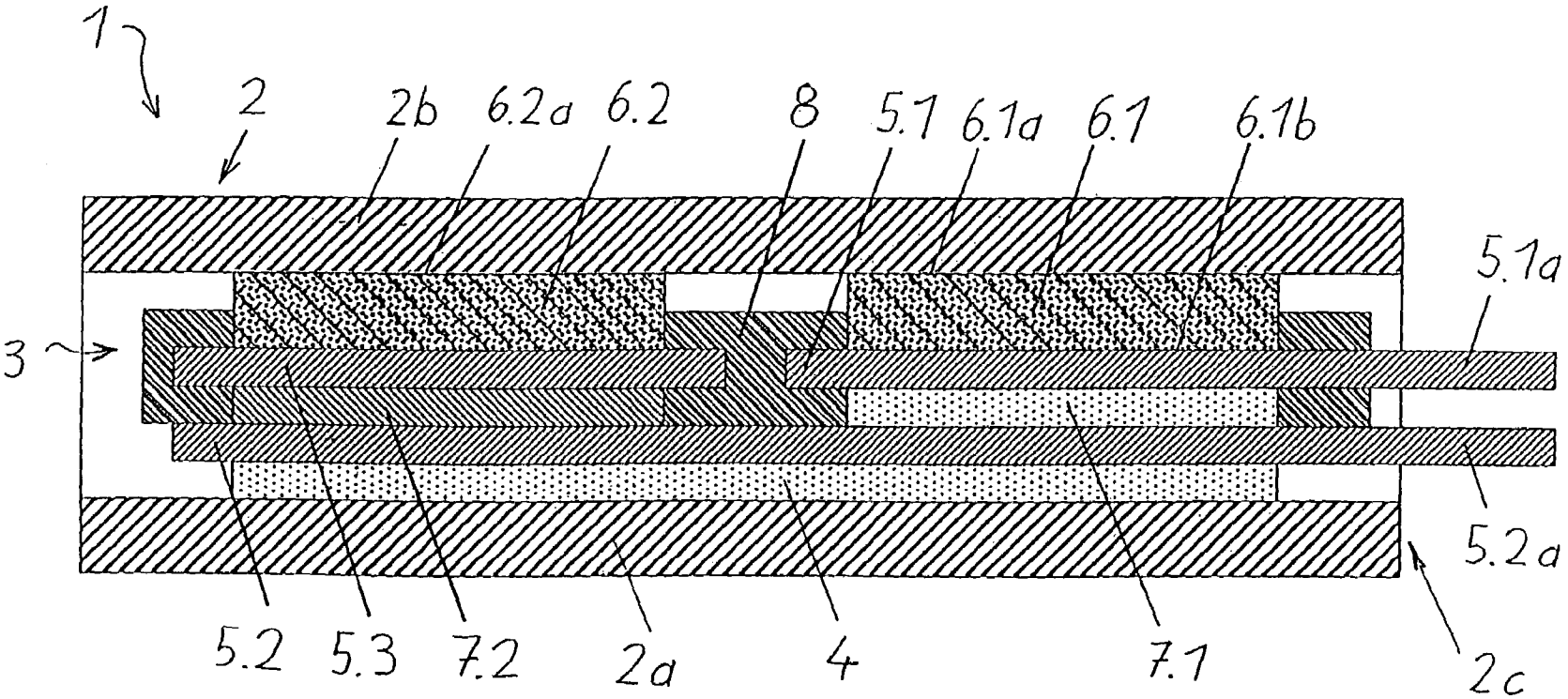
FIG. 5 A longitudinal section through a first embodiment of the heating device according to the invention.
Figure 6:
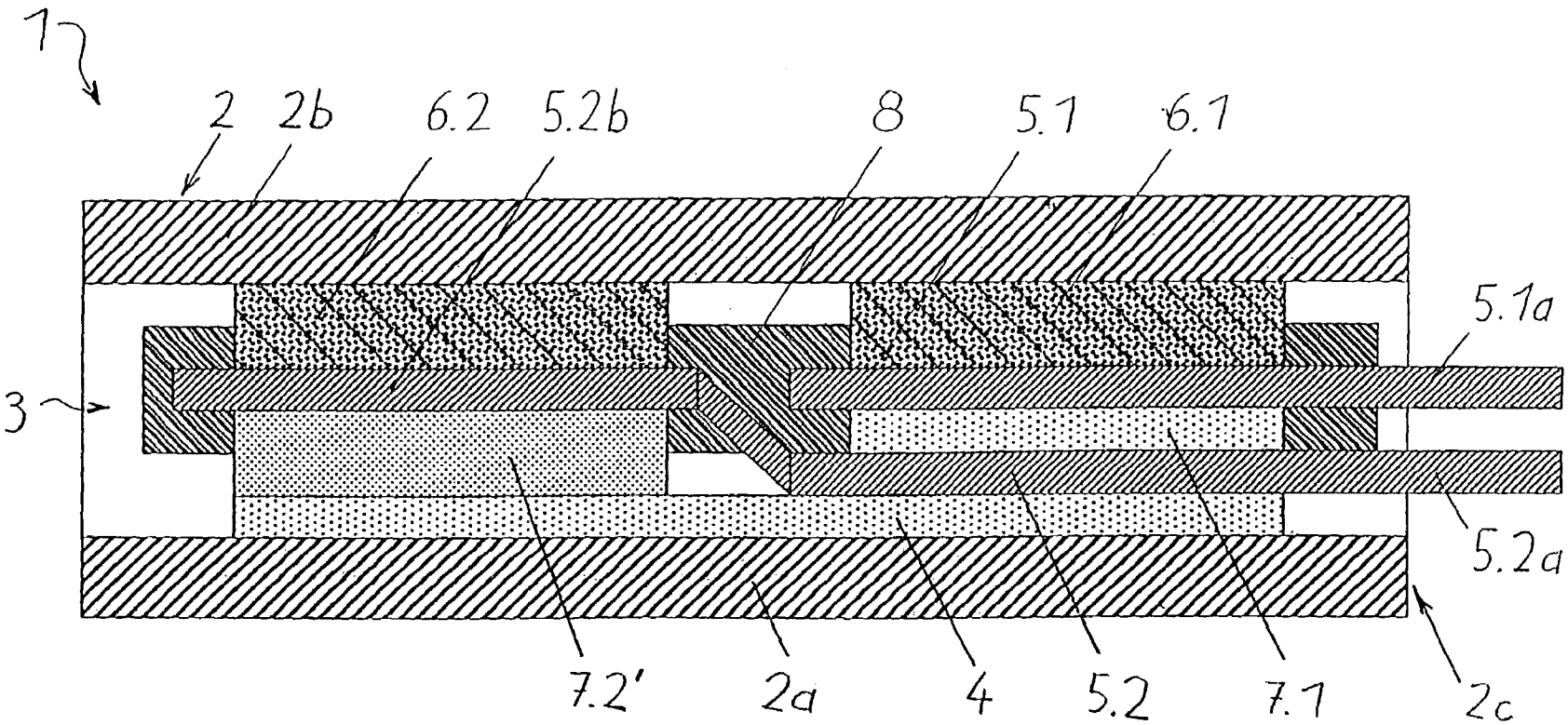
FIG. 6 A longitudinal section through another embodiment of the inventive heating device.
Figure 7:
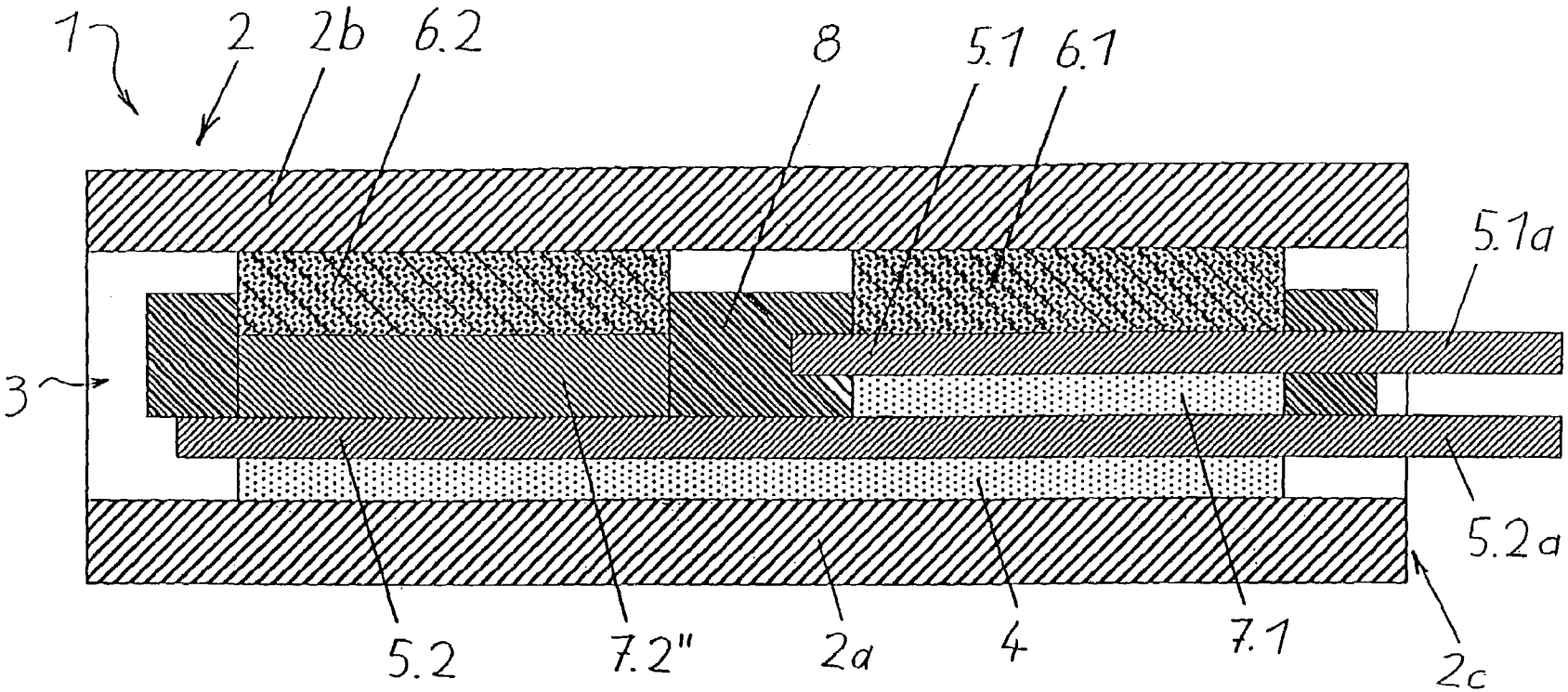
FIG. 7 A longitudinal section through a third embodiment of the inventive heating device.

Through the construction shown and described relative to FIGS. 5 to 7 it is possible with a radiator R formed from inventive heating devices 1 to create two heating zones (zones 1 and 2), in the manner shown in FIG. 2, which can be switched separately from one another, so that either only zone 1, or only zone 2, or both zones are heated.

Figure 3:
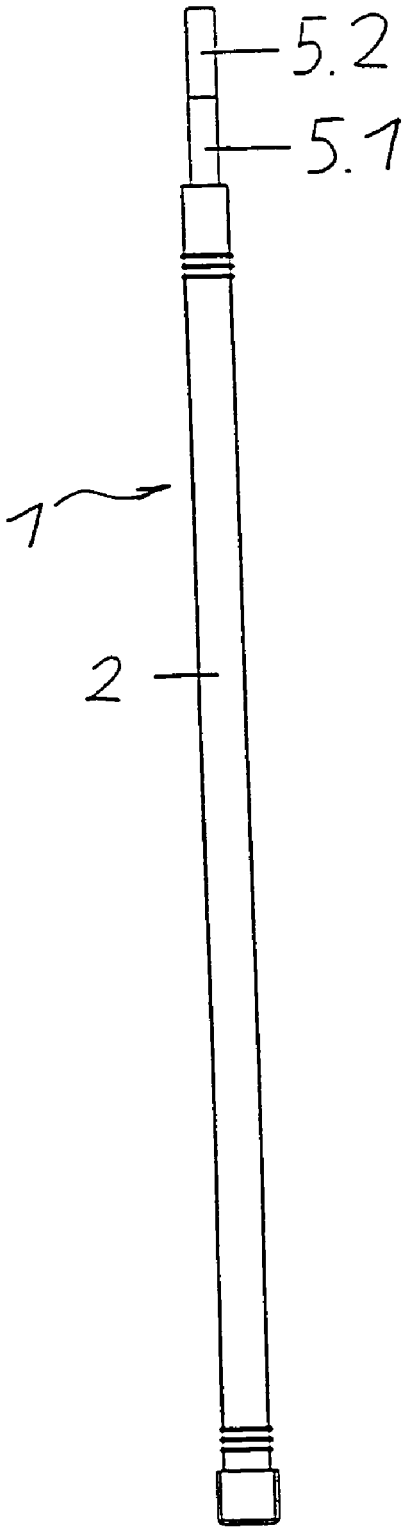
FIG. 3 A side view of an inventive heating device.
Figure 4:
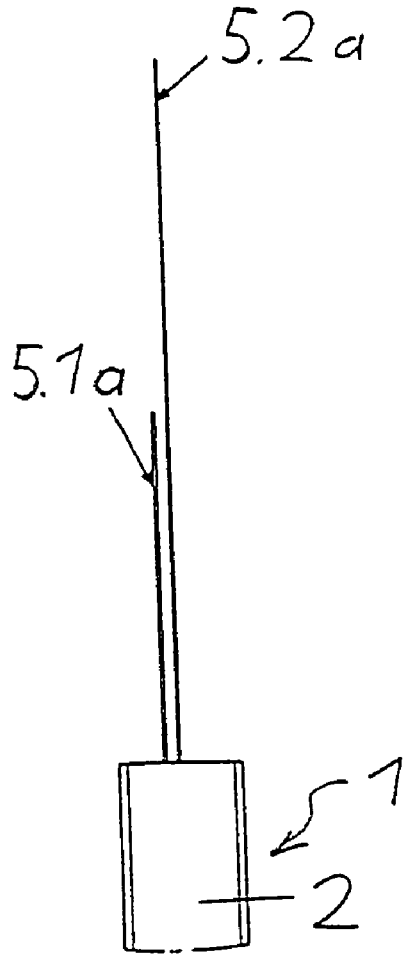
FIG. 4 A larger scale representation of the connection details of an inventive device.

FIG. 3 is a plan view of an inventive heating device 1 with a casing 2, as well as the conductors 5.1 and 5.2 projecting therefrom. A larger scale representation of the end region of a heating device 1 or detail A of FIG. 2 is shown in FIG. 4.

The inventive heating device 1 has a casing 2, which is made from good heat transmitting material and preferably metal. The casing 2 can be a tube, preferably a profile tube, with a cross-section adapted to the internal structure 3 of the device. The upper and lower surfaces are preferably pressed convexly (concavely to the outside) inwards against the inner structure 3 of the device.

The inner structure 3 of the heating device 1 according to the invention has, from bottom to top in the embodiment shown, firstly an insulating strip 4, which rests on a lower cover surface 2*a* of the casing 2 within the same. From a front side 2*c* of the casing extends a lamellar, electrical conductor 5.2 with an end 5.2*a* projecting from the casing 2.

Spaced from the conductor 5.2 and above the same in the embodiment shown, are provided two plate-like, ceramic heating elements 6.1 and 6.2, which engage directly with a flat side 6.1*a*, 6.2*a* on the upper cover surface 2*b* of the casing. On its lower surface 6.1*b* remote from the cover surface 2*b*, the first heating element 6.1 is contacted by a further lamellar, electrical conductor 5.1, whose end 5.1*a* is passed out of the casing 2 on the same side as the electrical conductor 5.2. For insulating the two conductors 5.1 and 5.2 and for bridging the distance between them, an insulating spacer 7.1 is provided between them in the vicinity of the heating element 6.1.

In the vicinity of the second heating element 6.2, between the latter and the second electrical conductor 5.2 in the embodiment shown, is provided a contact plate 5.3 and an electrically conducting spacer 7.2. The front sides of the casing can be moulded and, as stated, the ends 5.1*a* and 5.2*a* of the two conductors 5.1 and 5.2 are passed out of the front side of the casing.

Thus, the first heating element 6.1 and the second heating element 6.2 can be separately supplied with voltage from a single front side of the casing 2 and can in this way be heated. In place of a first element 6.1 and a second element 6.2, as shown in the drawing so as not to overburden the same, there can also be several first heating elements 6.1 and several second heating elements 6.2, which can be separately contacted in the same way and supplied with voltage. There can also be more than two separately contacted and voltage-suppliable, individual heating elements or several corresponding groups of heating elements (e.g. three or more), and for this purpose, e.g. on the side of the second conductor 5.2 remote from the heating elements, a third heating conductor is passed in insulated manner within the casing 2 to the connection side (at 5.1*a*, 5.2*a*) and on the side remote from the connection side is in electrically conductive contact with one or more heating elements.

Both the conductor 5.1 and the contact plate 5.3 are held in a central free space of a frame 9 and in particular the conductors can be moulded in or moulded round by the frame 8, which projects vertically over the conductor 5.1 and contact plate 5.3 with respect to the flat sides thereof and in this way also surrounds and positions the heating elements 6.1 and 6.2, together with the spacers 7.1 and 7.2.

The further conductor 5.2 can also be enclosed in such a frame.

The structure of the heating devices 1 of FIGS. 6 and 7 is fundamentally similar and in the vicinity of the first heating element 6.1 identical to the structure of the heater of FIG. 5. The construction according to FIG. 6 differs from that of FIG. 5 in that the second conductor 5.2 in the vicinity of the second heating element 6.2 is offset towards the latter, so that it is only necessary for there to be one spacer 7.2' between the offset area 5.2*b* of the second heating conductor 5.2 and the insulating strip 4. The spacer 7.2' can be conductive or non-conductive and is preferably non-conductive. Preferably the spacer 7.2' forms a constructional unit with the insulating strip 4 and is made in one piece, e.g. from moulded ceramic. Advantageously there is a further reduction in component numbers.

In the variant of FIG. 7 the contact plate 5.3 and electrically conductive spacer 7.2 of FIG. 5 are replaced by a one-piece, electrically conductive spacer 7.2", which can also be moulded in the holding frame 8. The resulting construction is particularly preferred, because it combines the advantages of reducing the number of components with a simple implementation during manufacture.

The invention claimed is:

1. Heating device with at least first and second plate-like ceramic heating elements, which are electrically contacted on opposite flat sides by flat electrical conductors whereby on at least one flat side of the first and second heating elements is provided at least one flat electrical conductor, wherein on another flat side of the heating elements there are at least two further flat electrical conductors which are electrically insulated against one another, each of the further flat electrical conductors being in contact with the another flat side of only a respective one of the first and second heating elements.

2. Device according to claim 1, wherein at least one of the at least two further flat electrical conductors is in direct contact with a heating element.

3. Device according to claim 1, wherein at least one of the at least two further flat electrical conductors is in indirect contact with a heating element.

4. Device according to claim 3, wherein at least one of the at least two further flat electrical conductors is in contact via at least one electrically conductive spacer with at least one heating element.

5. Device according to claim 4, wherein at least one of the at least two further flat electrical conductors is in contact via at least one electrically conductive spacer and a contact plate with a heating element.

6. Device according to claim 1, wherein at least one electrical conductor and/or electrically conductive contact plate are circumferentially held by at least one insulating frame.

7. Device according to claim 1, wherein at least one electrical conductor and/or electrically conductive spacer are circumferentially held by at least one insulating frame.

8. Device according to claim 1, wherein the at least two further flat conductors are electrically insulated against one another by at least one insulating spacer located between them.

9. Device according to claim 1, wherein at least one conductor has an area offset to at least one heating element.

10. Device according to claim 1, wherein the at least two further flat electrical conductors are contacted solely from one front side of the casing.

11. Device according to claim 1, wherein heating elements and conductors, together with optionally spacers are placed in a casing.

12. Device according to claim 11, wherein heating elements, conductors and optionally spacers are pressed in the casing.

13. Device according to claim 10, wherein the casing has an electrically conductive construction and at least one flat side of the casing is in electrical contact with the flat side of at least one heating element remote from the at least two further flat electrical conductors.

14. Device according to claim 1, wherein at least one of the electrical conductors and/or electrically conductive spacer is in injection-moulded around by an insulating holding frame for the heating elements.

15. Method for the manufacture of a heating device according to claim 1, wherein initially at least one electrical conductor and/or electrically conductive spacer is injection-moulded around with an insulating holding frame for the heating elements.

16. Heating device with at least first and second plate-like ceramic heating elements, which are electrically contacted on opposite flat sides by flat electrical conductors whereby on at least one side of the first and second heating elements is provided at least one flat, electrical conductor, wherein on another side of the heating elements there are at least two flat conductors which are electrically insulated against one another, each of the at least two flat conductors being in contact with only a respective one of the first and second heating elements and wherein at least one of the two flat electrical conductors is in indirect contact with a flat side of one of the heating elements.

17. Device according to claim 16, wherein at least one of the two flat electrical conductors is in indirect contact with the flat side of at least one of the heating elements via at least one electrically conductive spacer.

18. Device according to claim 16, wherein at least one of the two flat electrical conductors is in indirect contact with the flat side of at least one of the heating elements via at least one electrically conductive spacer and a contact plate.

19. Heating device with at least first and second plate-like ceramic heating elements, which are electrically contacted on opposite flat sides and on at least one flat side of the first and second heating elements is provided at least one flat electrical conductor, wherein on another flat side of the heating elements there are at least two further flat electrical conductors which are electrically insulated against one another, each of the further flat electrical conductors being in contact with the another flat side of a respective one of the first and second heating elements, wherein at least one of the two further flat electrical conductors bent so as to have one part in direct contact with another flat side of a respective one of the first and second heating elements and another part offset therefrom and spaced from another flat side of a respective other one of the first and second heating elements.

* * * * *